United States Patent [19]

Alexandrovich, Sr. et al.

[11] 4,030,002

[45] June 14, 1977

[54] DEGAUSSER

[76] Inventors: George Alexandrovich, Sr., 7 Glenmere Court, Commack, N.Y. 11725; Edward Perper, 1125 E. 57th St., Brooklyn, N.Y. 11234

[22] Filed: Nov. 6, 1975

[21] Appl. No.: 629,547

[52] U.S. Cl. ..... 361/151; 335/284

[51] Int. Cl.[2] ..... H01F 13/00

[58] Field of Search ..... 317/157.5; 335/284; 360/128; 310/50

[56] References Cited

UNITED STATES PATENTS

| | | | |
|---|---|---|---|
| 3,435,300 | 3/1969 | Sato | 317/157.5 MR |
| 3,588,936 | 6/1971 | Duve | 310/50 |

FOREIGN PATENTS OR APPLICATIONS

| | | | |
|---|---|---|---|
| 809,664 | 2/1959 | United Kingdom | 317/157.5 |

*Primary Examiner*—R. N. Envall, Jr.

[57] ABSTRACT

A degausser has a housing having two housing sections of generally tubular configurations. A support element is accommodated in the interior of the housing, and has a tubular portion and a generally flat portion. A core of an electromagnet is accommodated in the tubular portion of the support element, and a coil of the electromagnet surrounds a part of the tubular portion in the housing. The flat portion is formed with resiliently yieldable projections which engage associated recesses at the housing sections with snap action so as to connect the housing sections to the support element. Electric leads pass through an opening of one of the sections, are received in slots of the flat portion in a labyrinthine manner, and connected to a switch supported on the support element and having an actuating element passing through a slot in the housing to the exterior of the latter. The housing and the support element are of synthetic plastic material.

13 Claims, 3 Drawing Figures

DEGAUSSER

BACKGROUND OF THE INVENTION

The present invention relates to a demagnetizer, and more particularly to a magnetic head demagnetizer.

Magnetic head demagnetizers or degaussers are already known, as well as their use for demagnetizing magnetic heads of tape recorders, tape players and similar arrangements. The reasons for providing such degaussers is that the magnetic heads of recording or reproducing arrangements acquire some residual magnetism during their use, so that the quality of the recording and the quality of the rendition suffer. Therefore, it is necessary, from time to time, to demagnetize the magnetic heads of tape recorders or tape players, especially in high fidelity equipment.

This problem has already been recognized and various models of degaussers are already on the market. However, these conventional degaussers are disadvantageous as far as their cost, durability and utilization are concerned. In most of the known degaussers, a plurality of components is present which are connected to one another in a rather complex and laborious way.

SUMMARY OF THE INVENTION

Accordingly, it is a general object of the present invention to avoid the disadvantages of the prior art degaussers.

More particularly, it is an object of the present invention to provide a reliable and economically attractive degausser.

It is a further object of the present invention to provide a degausser in which the various components thereof can be easily assembled and disassembled.

It is yet another object of the present invention to provide a degausser in which most of the parts are made of inexpensive materials Finally, it is an object of the present invention to so construct a degausser that all of the components thereof are supported on a single support member.

In pursuance of these objects and others which will become apparent hereafter, one feature of the present invention resides, briefly stated, in a degausser which comprises a housing including two housing sections; an arrangement for connecting the housing sections to one another; a support element accommodated in the interior of the housing; and an arrangement for generating a magnetic field active outside the housing for degaussing a magnetic head of a tape recorder or player, the magnetic arrangement being supported on the support element. The support element has connecting portions which engage with snap action associated detent recesses on the housing sections so as to connect the housing sections to the support element.

In a currently preferred embodiment of the present. invention, the magnetic arrangement includes an electromagnet which includes a core accommodated in a tubular portion of the support element, and a coil which is convoluted around a part of the tubular portion, another part of the tubular portion with the core within it extending outwardly of the housing.

It is also currently preferred that the support element have a flat portion on which there is mounted a switch which has an actuating element received in an elongated slot provided in at least one of the housing sections for movement longitudinally of the slot. The flat portion is preferably provided with positioning projections which engage the internal walls of the housing to position the support element relative thereto. The flat portion, as currently proposed, is formed with at least two slots, and the electric leads supplying electric current to the electromagnet are guided through the slots in a labyrinthine manner so as to connect the leads to the support element and prevent the former from displacement relative to the latter.

The housing sections may be made, according to the currently preferred embodiment of the invention, of a synthetic plastic material, preferably of a thermosetting synthetic plastic material. Such materials are well known and in widespread use through the industry, so that it is not believed necessary to list such materials. Examples of synthetic plastic materials which could be used are polyethylene and formaldehyde resins. Similarly, the support element may be made of a synthetic plastic material, the only requirements of the material of the support element being that it be electrically nonconductive but magnetically permeable, and that it be elastically yieldable at least to some extent in order to permit the snap action engagement of the connecting projections with the detent recesses of the housing sections.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
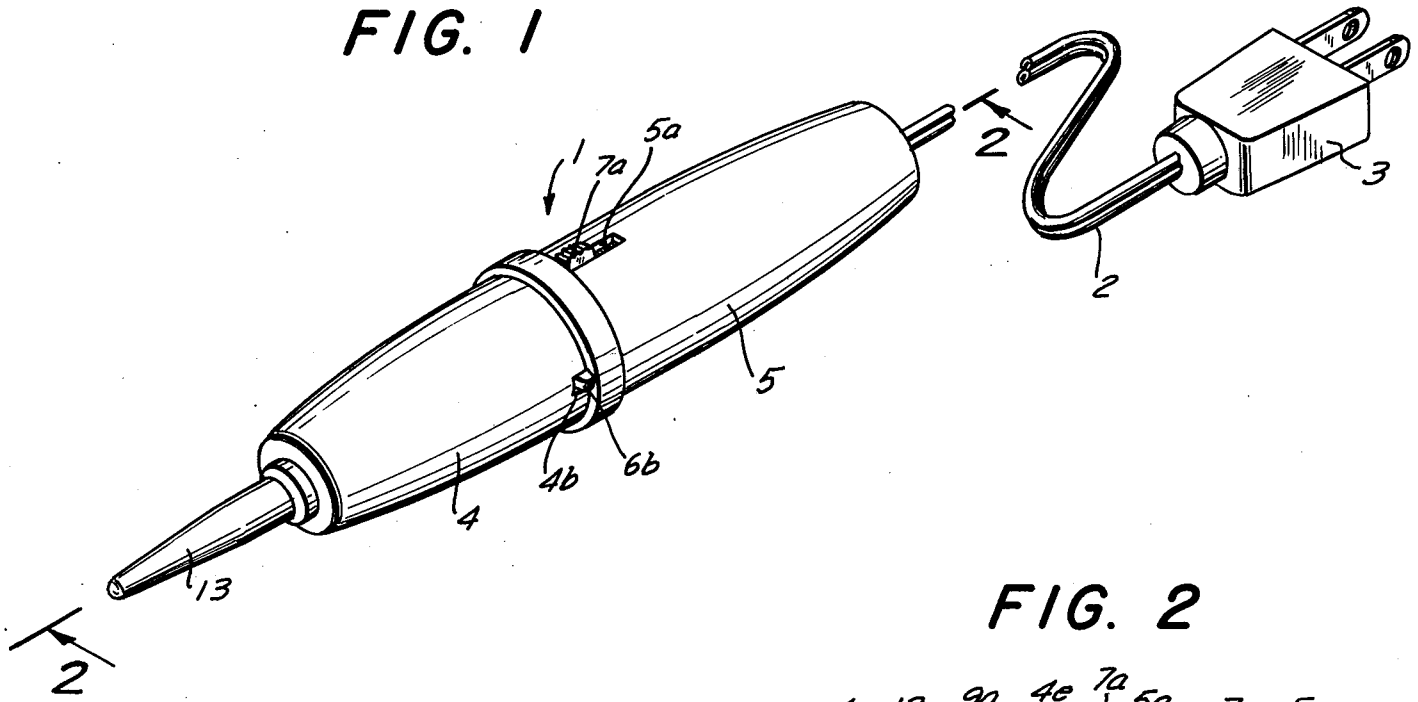
FIG. 1 is a perspective view of a degausser of the present invention in its assembled condition.

Referring now to the drawings, and first to FIG. 1, it may be seen that the degausser 1 is designated in toto with the reference numeral 1. An electric wire 2 extends outwardly of housing of the degausser 1, and a plug 3 is connected to the remote end of the wire 2 and serves the purpose of connecting the wire 2 and thus the degausser 1 to a source of electric current.

Coming now to FIG. 2 in which some parts of the assembly have been omitted for the sake of clarity, it may be seen that the degausser 1 includes a housing which consists of two substantially tubular sections 4 and 5, and a support element accommodated in the interior of the housing in a manner which will be explained in more detail later on. The support element includes an essentially flat portion 6, a portion 9 which is connected to the flat portion 6 and extends transversely thereof, a substantially tubular portion 11, a collar 10 and a tubular conically converging portion 13. All of these portions of the support element are either integral with one another or connected to one another by an adhesive or in a similar manner, such as by welding. A magnetic core 8 is accommodated in the interior of the tubular portions 11 and 13 and extends through the collar 10. An electromagnetic coil 12 is convoluted about the tubular portion 11 between the portion 9 and the collar 10. Connecting webs 13*a* connect the tubular portion 13 to the collar 10.

Figure 2:
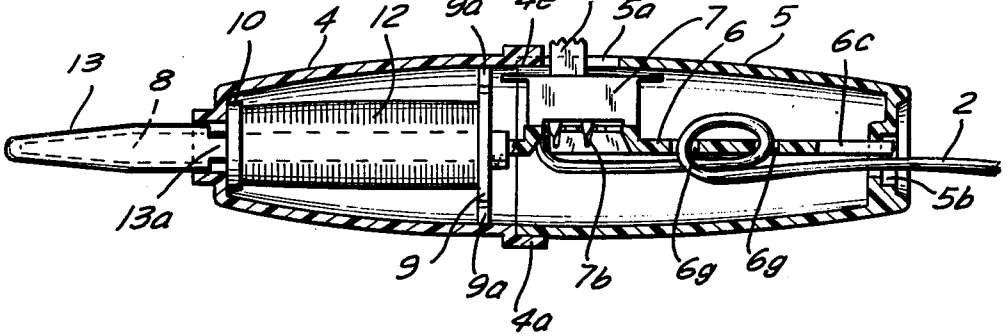
FIG. 2 is a partly cross-sectional side elevational view of the degausser takn on line 2—2 of FIG. 1.
Figure 3:
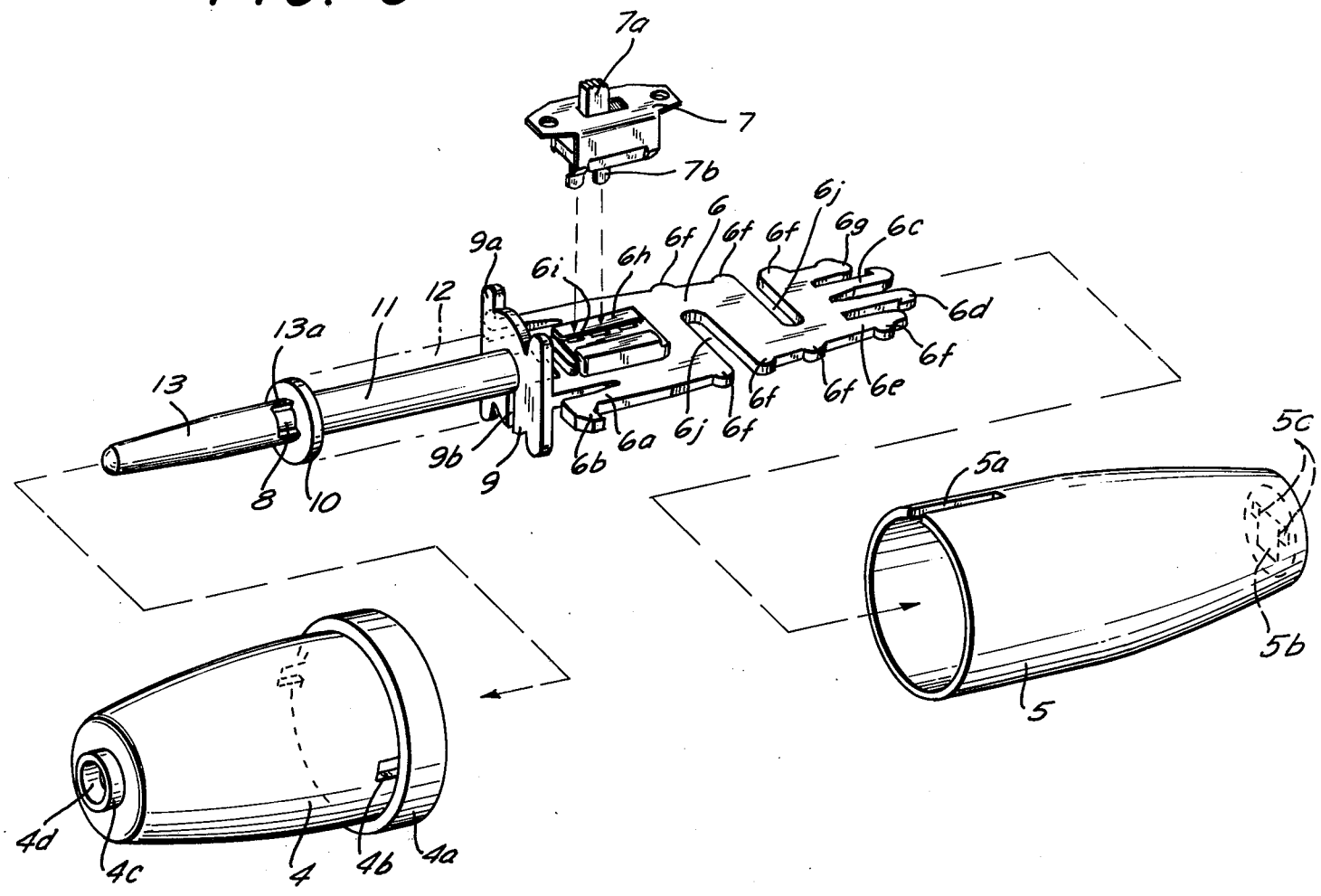
FIG. 3 is an exploded perspective view of the assembly of FIG. 1.

The housing section 4 has a sleeve-shaped portion 4*a* which overlies and circumferentially surrounds a part of the housing section 5 when the housing is assembled, as illustrated in FIG. 2. Two slots 4*b* are provided in the housing section 4, the purpose of which will be later explained. The housing section 4 is further formed with a sleeve 4*c* which circumferentially surrounds an opening 4*d* through which the tubular portion 13 of the support element extends when the housing of the degausser 1 is assembled.

The housing section 5 has a slot 5*a* whose purpose will also be explained later, an opening 5*b* for the passage of the wire 2 therethrough, and two recesses 5*c* at the outside of the housing section 5 and laterally of the opening 5*b*.

The essentially flat portion 6 of the support element includes a pair of resiliently yieldable projections 6*a*, each formed with a substantially radially extending tongue 6*b* adapted to snap into the openings 4*b* of the housing section 4 upon assembly of the housing section 4 with the support element. The essentially flat portion 6 further includes other projections 6*c*, each formed with a substantially radially extending tooth 6*d* operative for engaging, with snap action, the depression 5*c* of the housing section 5 when the latter is assembled with the supporting element. The flat portion 6 of the support element includes further projections 6*e* extending substantially longitudinally of the degausser 1, each provided with a round portion 6*g* which abuts against the housing section 5*a* at the opening 5*b* and laterally thereof when the housing section 5 is assembled with the supporting element. A plurality of rounded projections 6*f* is formed on the flat portion 6 of the supporting element, these projections 6*f* abutting against the internal circumferential surface of the housing section 5 when the latter is assembled with the supporting element, thus positioning the flat portion 6 of the supporting element relative to the housing section 5. The flat portion 6 is further formed with at least two slots 6*j* through which the wire 2 is guided in a labyrinthine fashion as seen in FIG. 2, the labyrinthine convolution of the wire 2 securely connecting the wire 2 to the flat portion 6 of the supporting element. The flat portion 6 of the supporting element is further formed with a projection 6*h* in which there is provided a plurality of through slots 6*i*.

A commercially available switch of a conventional construction is located on and attached to projection 6*h* of the flat portion 6 so that its terminals 7*b* extend through the slots 6*i*, simultaneously connecting the switch to the flat portion 6. At least one of the leads of the wire 2 is connected to at least one of the terminals 7*b*. The switch 7 has an actuating element 7*a* which, when the switch is connected to the flat portion of the supporting element, and the latter is assembled with the housing section 5, is received in the slot 5*a*, extending from the interior of the housing to its exterior so as to be displaceable from the exterior of the housing. Of course, the displacement of the actuating element 7*a* from one of its end positions to the other one results in closing of the electric circuit or in interrupting the same, respectively.

The portion 9 of the supporting element has rounded projections 9*a* which, when the housing section 4 is assembled with the supporting element, engage the internal circumferential surface of the housing section 4. Furthermore, the portion 9 is formed with a slit 9*b* for receiving a wire connecting the coil 12 either to one of the leads of the wire 2 or to one of the terminals 7*b* of the switch 7.

Referring now more particularly to FIG. 2, it will be appreciated therefrom that the wire 2 is convoluted around a flat portion 6 and through the slots 6*j* thereof, that the actuating element 7*a* of the switch 7 is received in the slot 5*a* of the housing section 5 for movement longitudinally thereof, and that the collar or sleeve portion 4*a* of the housing section 4 partially surrounds the end of the housing section 5. In addition thereto, it may be seen that the sleeve 4*a* is provided at its inner surface with an axially extending projection 4*e* which is also received in the slot 5*a* and prevents rotation of the housing sections 4 and 5 relative to one another.

All of the elements of the degausser 1, except for the core 8, the coil 12 and the electrically conductive portions of the wire 2 and the switch 7 may be made in a very simple manner, such as by pressing or injection molding, of a synthetic plastic material. More particularly, the housing sections 4 and 5 may be made of thermosetting synthetic plastic material, whereas the support element may be made of an elastically yieldable material, such as of a synthetic plastic material. The materials which can be used for the various elements of the assembly are, for instance, polyethylene or formaldehyde resins.

Having so discussed the construction and configuration of the various elements of the degausser 1, the assembly and operation thereof will now be briefly discussed.

To assemble the degausser, the core 8 is first introduced into the tubular portions 11 and 13 so as to pass through the collar 10, and then the parts or portions of the supporting elements which are not already integral with one another are adhesively connected or welded together. Then the switch 7 is connected to the projection 6*h* of the flat portion 6 so that the terminals 7*b* thereof extend to the other side of the flat element 6. Subsequent thereto, the coil 12 is convoluted around the tubular portion 11 between the portion 9 and the collar 10, at least one of the ends of the wire forming the coil being passed through the slot 90 of the portion 9 of the supporting element and connected, such as by soldering, either to one of the terminals 7*b* or to one of the leads of the wire 2. The other lead of the wire 2 may then be connected to the other terminal 7*b*.

The wire 2, prior to being soldered either to one of the ends of the wire forming the coil 12 or to one of the terminals 7*b*, may be convoluted around the supporting element and more particularly through the slots 6*j* thereof, in a labyrinthine fashion, and passed through the opening 5*b* of the housing section 5. Finally, the housing sections 4 and 5 are assembled with the supporting element so that teeth 6*d* engage in the depressions 5*c*, the teeth 6*d* snap into the openings 4*d*, the actuating element 7*a* is received in the slot 5*a* for movement longitudinally thereof, and the internal projection 4*e* is also received in the slot 5*a* so as to prevent rotation of the housing sections 4 and 5 relative to one another and to the supporting element. In addition thereto, the rounded portions 6*f*, 6*g* and 9*a* engage the internal surfaces of the housing sections 4 and 5 so as to position the supporting element relative to the housing sections 4 and 5, and to prevent radial and axial displacement of the housing sections 4 and 5 relative to the supporting element.

When the degausser is to be used, then the plug 3 is inserted into a socket while the actuating element 7*a* of the switch 7 is in its off position, then the tubular portion 13 of the supporting element with a portion of the core 8 therein is introduced to a magnetic head or a similar element to be demagnetized or degaussed, and the actuating element 7*a* is moved into its on position whereby the coil 12 is energized and generates a magnetic field acting through the core 8 and the tubular element or portion 13 at the outside of the housing upon the magnetic head or the similar element to be demagnetized. The operation of the demagnetizer or degausser 1 is so well known that it needs no further elaboration.

If so desired, the switch 7 can be omitted and then the degausser 1 is energized by plugging the plug 3 into an outlet. This results in a less complicated and, consequently, less expensive embodiment of the degausser 1 which is only slightly less reliable and convenient then the embodiment described and discussed above.

It will be understood that each of the elements described above, or two or more together, may also find a useful application in other types of constructions differing from the type described above.

While the invention has been illustrated and described as embodied in a degausser, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A degausser for degaussing magnetized components, comprising an elongated hollow housing having an internal surface and subdivided at a plane transverse to the elongation thereof into two discrete housing sections having respective detent recesses; a support having a plurality of elastically yieldable support portions which contact said internal surface of said housing to thereby position and support said housing sections on said support element, and of elastically yieldable detent projections which engage with snap action in said detent recesses of said housing sections to thereby connect the latter to said support element, said support element including a flat portion, and a tubular portion of magnetically permeable material, which are rigid with one another and extend longitudinally of said housing, said flat portion and one part of said tubular portion being accommodated in said housing, and another part of said tubular portion extending to the exterior of and longitudinally beyond said housing for juxtaposition with a component to be degaussed; and means for generating a magnetic field in the circumambient region of said other part of said tubular portion to degauss the component upon juxtaposition of said other part therewith, including a core received in and surrounded by said tubular portion of said support element and extending within said parts thereof, a coil convoluted at least around a region of said one part of said tubular portion of said support element, and means for supplying electric current to said coil so as to generate an electromagnetic field which penetrates through said tubular portion of said support element and acts on the component juxtaposed with said other part of said tubular portion.

2. A degausser as defined in claim 1, wherein said means for supplying current to said electromagnet, includes electric leads; and wherein one of said housing sections is provided with an opening for passage of said electric leads therethrough.

3. A degausser as defined in claim 2, wherein said supplying means includes a switch interposed between at least one of said electric leads and said coil.

4. A degausser as defined in claim 3, wherein said switch includes an actuating element; wherein said switch is accommodated in said housing; and wherein at least one of said housing sections is formed with an elongated slot in which said actuating element is received for movement longitudinally of said slot, and through which it extends to the exterior of said housing.

5. A degausser as defined in claim 4, wherein said switch is connected to said support element.

6. A degausser as defined in claim 2, wherein said support element includes at least two slots; and wherein said electric leads pass through said slots in a labyrinthine manner so as to be connected to said support element.

7. A degausser as defined in claim 1, and wherein said support element includes connecting portions having said detent projections.

8. A degausser as defined in claim 1, wherein said housing sections are of a synthetic plastic material.

9. A degausser as defined in claim 1, wherein said housing sections are of a thermosetting synthetic plastic material.

10. A degausser as defined in claim 1, wherein said support element is of a synthetic plastic material.

11. A degausser as defined in claim 1, wherein said support element is entirely of an elastically yieldable material.

12. A degausser as defined in claim 1, wherein said housing has a longitudinal axis; and further comprising means for preventing rotation of one of said housing sections relative to the other housing section about said longitudinal axis.

13. A degausser as defined in claim 12, wherein said preventing means includes a recess on one of said housing sections at said plane, and a projection on the other housing section in engagement with said recess.

* * * * *